United States Patent [19]

Möltner

[11] Patent Number: 4,480,457

[45] Date of Patent: Nov. 6, 1984

[54] PLANTS FOR MANUFACTURING SEAMLESS TUBES

[75] Inventor: Hermann Möltner, Grevenbroich, Fed. Rep. of Germany

[73] Assignee: Kocks Technik GmbH & Co., Hilden, Fed. Rep. of Germany

[21] Appl. No.: 428,261

[22] Filed: Sep. 29, 1982

[30] Foreign Application Priority Data

Oct. 8, 1981 [DE] Fed. Rep. of Germany ..... 3140015

[51] Int. Cl.[3] ..... B21B 17/06

[52] U.S. Cl. ..... 72/208; 72/368

[58] Field of Search ..... 72/68, 206, 208, 212, 72/213, 368, 370

[56] References Cited

U.S. PATENT DOCUMENTS

| | | | |
|---|---|---|---|
| 2,105,150 | 1/1938 | Korbuly | 72/208 |
| 4,262,516 | 4/1981 | Weber et al. | 72/208 |

FOREIGN PATENT DOCUMENTS

| | | | |
|---|---|---|---|
| 870235 | 3/1953 | Fed. Rep. of Germany | 72/368 |
| 1452482 | 2/1969 | Fed. Rep. of Germany | 72/208 |
| 2812778 | 9/1979 | Fed. Rep. of Germany | 72/368 |

*Primary Examiner*—Lowell A. Larson

*Attorney, Agent, or Firm*—Buell, Blenko, Ziesenheim & Beck

[57] ABSTRACT

A plant for the manufacture of seamless tubes is provided having successively a roughing unit and a finishing push bench unit which finish push bench unit includes all sizing passes which are simultaneously in operation with the finishing passes on a tube at the end of the elongation operation.

4 Claims, 2 Drawing Figures

PLANTS FOR MANUFACTURING SEAMLESS TUBES

This invention relates to plants for manufacturing seamless tubes and particularly to plants having a finishing push bench equipped with only that number of drawing passes which can be used simultaneously on a tubular bloom without risk of necking or bulging and preceded upstream by at least one roughing unit for stretching and reducing an ingot or pierced blank to form a bloom.

Seamless tubes are manufactured by using, inter alia, the known push bench method which has been developed from the Enrhardt method. The latter method enables the manufacture of seamless hollow bodies of circular cross section, designated pierced blanks, from semi-finished products of square cross section, the latter being an inexpensive starting material. A semi-finished product of square cross section at hot-forming temperature is then introduced into a die having a cylindrical interior space, the diagonal dimensions of the semi-finished product corresponding approximately to the internal diameter of the die. A piercing mandrel is then pressed centrally into the workpiece in the direction of the longitudinal axis thereof, thus producing a pierced blank of circular cross section which is closed at one end portion by a base. Practical experience has shown that the ratio of the length of the pierced blank to the diameter of the piercing mandrel cannot be chosen to be greater than 8:1, since, otherwise, the piercing mandrel deviates laterally when it is being pressed into the workpiece, and the pierced blank is formed with irregular wall thicknesses which cannot be eliminated at an economically acceptable expense during further processing. Consequently, the pierced blank is relatively short and thick-walled and is governed by specific dimensional ratios which could not be exceeded in the first instance, thus resulting in limitation of the quantity of material which could be used as a workpiece. Only very short tubular blooms, which are therefore uneconomical for manufacture and further processing, were obtained with the push bench, particularly in the case of large wall thicknesses.

However, it has been possible to increase the weight of the pierced blanks used by employing the method described in German patent specification No. 12 98 494. In this method, a stepped piercing mandrel is pressed into the workpiece which is located in a die which tapers downwardly in a bottle-neck-like manner. The greater portion of the workpiece is then perforated with a diameter which is larger than the internal diameter provided in the finished tubular bloom. This means that the starting material can be a semi-finished product of larger cross section and weight. Only the smaller diameter portion of the piercing mandrel corresponds to the diameter of the mandrel rod. The portion of the pierced blank which is thereby pierced serves to centre the mandrel rod during subsequent pushing. The resultant increase in the weight of material which can be worked follows from the ratio of the graduation of the diameters of the piercing mandrels. Since only the diameter of the short centering extension of the piercing mandrel corresponds to the internal diameter of the tubular bloom during this stepped piercing operation, and the actual diameter of the piercing mandrel can be freely chosen, and thus the weight of the pierced blank is virtually free from the diameter of the piercing mandrel and thus from the internal diameter of the tubular bloom, pierced blanks of larger cross sections, greater length and greater weight can be produced, so that, since then, the limits of the push bench method lie in the region of the push bench itself.

The limits of the push bench are decided by various factors. In the meantime, the distances between the roller stands have been optimised, so that it appears to be scarcely possible to further shorten the lengths of the strokes. It is also unlikely that the pushing speed can be increased, since the pushing force required necessitates a relatively large mass of the toothed rack and the other parts of the drive, thus leading to high accelerative and decelerative forces which scarcely permit a further increase in the pushing speed. A further reduction of the pushing force also cannot be anticipated, since the sizing passes are formed from rolls whose shapes and dimensions have also been largely optimised, so that it is impossible to reduce the masses in a manner which would in turn increase the pushing speed. Since, for the reasons given above, the length of the stand bed cannot be further shortened in a conventional push bench plant with a specific length of tubular bloom, and the pushing speed also cannot be increased, there is also a specific period of contact between the mandrel rod and the tubular bloom when the latter is of a certain length. In view of the cooling of the tubular bloom and the heating of the mandrel rod, this period of contact cannot be prolonged to an optional extent. However, since the period of contact would increase with increasing length of the tubular bloom, it was impossible in the first instance to increase the length of the tubular blooms produced on a push bench, and the possibility of stepped piercing, enabling a greater weight of material to be worked, could not be utilized.

Nevertheless, in order to produce tubular blooms of greater length, it is proposed in German patent specification (Offenlegungsschrigt) No. 28 12 778 to dispose a roughing unit, that is to say, a further push bench, upstream of the finishing push bench. Hence, it is, in fact, possible to produce tubular blooms having a length in excess of 20 meters, for example, 22 meters and in excess thereof, and in at least the same numbers as hitherto.

The invention relates to a plant of this kind for the manufacture of seamless tubes, having a finishing push bench upstream of which is disposed at least one roughing unit, such as a skew rolling mill or a roughing push bench, for the purpose of stretching and reducing an ingot or pierced blank to form a roughed bloom.

In the known plant as described in the above-mentioned German patent specification (Offenlegungsschrift) No. 28 12 778, it is proposed that the finishing push bench should undertake preferably 20 to 35 percent, no more than 50 percent, of the entire reduction in the cross section in the plant, while the roughing push bench should undertake the greater portion, that is to say, the remaining 65 to 80 percent or at least 50 percent, of the entire reduction in the cross section in the plant. Since it is desired to obtain a tubular bloom having the largest possible length, the weight of the starting ingot has to be increased to a considerable extent. Owing to the circumstances discussed initially, this leads to substantially larger cross sections of the ingots, with the result that there is also a correspondingly large increase in the amount of elongation required. In the case of a finished bloom having a length of, for example, 22 meters, the ingot or pierced blank has to be elongated approximately 50-fold to form the finished bloom. In practical operation, this large amount of elongation is possible only by the known use of a roughing unit, since the length of the stand bed and thus the overall length of the finishing push bench would have unjustifiable dimensions. Therefore, if one bases one's consideration on the known type of construction, and distributes the 50-fold elongation performed by the entire plant (which corresponds to a reduction in cross section of 98%) in a known manner to the finishing push bench and the roughing unit, the degree of elongation remaining for the finishing push bench is no more than 25-fold, preferably 10-fold to 17-fold, corresponding to a reduction in cross section of no more than 50 percent, preferably 20 to 35 percent of the total reduction, as has been proposed in German patent specification (Offenlegungsschrift) No. 28 12 778. With the last-mentioned values, the degree of elongation performed by the finishing push bench lies in the range of the conventional layout.

A 17-fold elongation, corresponding to a reduction in cross section of approximately 94 percent, is approximately the upper limit of the capacity of a push bench. This upper limit is set by the length of the push bench, particularly the length of the stand bed, which can still be realized in practice. The length of the push bench is limited even when there is sufficient space within the workshop. That is to say, the length of the strokes of the axially moving parts cannot be increased to an optional extent, since this leads to an inadmissibly long period of contact between the mandrel rod and tubular bloom. This period of contact cannot be shortened by increasing the pushing speed, since this is precluded by the associated increase in the accelerative and decelerative forces with a simultaneous increase in the moved masses owing to the larger length of the stroke. The pushing speed would even have to be reduced even with an increase in the length of the stroke. Thus, owing to these mutually opposing requirements, the length of a stroke, and thus the length of the stand bed, cannot be increased beyond a predetermined value. However, the length of the stand bed, which is determined thereby, only renders it possible to provide a predetermined number of sizing passes which also cannot be exceeded. The number of drawing passes limited in this manner only permits of an approximate 17-fold elongation or 94 percent reduction in cross section as a maximum.

In a push bench, the drawing passes are distributed over the length of the stand bed such that only a limited number of drawing passes simultaneously participates in the drawing operation during pushing. Only two or three sizing passes are in engagement at the same time at the start of the row of sizing passes, and the base of the pierced blank must be prevented from being pierced by too large pushing forces. This risk exists in the first drawing passes for the reason that this is where almost the entire pushing force is transmitted by way of the base of the pierced blank, since this is where the frictional connection between the outer surface of the mandrel rod and the interior surface of the pierced blank is still inadequate. This improves as the pushing operation progresses, wherein the material to be deformed is pressed onto the mandrel rod with increasing firmness, greater adhesion occurs, and an increasing proportion of the pushing forces are transmitted by way of the outer surface of the mandrel rod and no longer by way of the base of the pierced blank. Consequently, there is no longer any risk of penetration of the base towards the end of the drawing operation. Nevertheless, the number of sizing passes operating at the same time is even then limited, since trouble in the form of necking-down of the tubes or compression of the tubes between the sizing passes can occur, if the number of sizing passes operating at the same time becomes too large. In order to prevent an inadmissible number of drawing passes from being in operation at the same time, the drawing passes have to be placed in the stand bed at correspondingly large distances apart. This results in a great length of the stand bed and thus of the stroke and the entire push bench. Although the number of sizing passes operating at the same time continuously increases during the course of the elongation operation, the sizing passes have to be disposed at increasingly greater distances apart towards the delivery end, since the length of the tubular bloom also continuously increases, and only the large distances apart can prevent an inadmissible number of drawing passes from being in operation at the same time. A total reduction in cross section of from 70 to 80 percent of all the sizing passes acting upon the tubular bloom at the same time should not be exceeded.

Thus, for the reasons given above, there is a direct relationship between the total elongation on a push bench, the length of the finished bloom, the length of the stand bed and thus the length of the entire push bench. In the known plant, the finishing push bench is designed according to the aforementioned criteria, that is to say, its elongation lies in the range of the upper limit, and only the remaining elongation required to obtain the finished bloom from the existing pierced blank is allocated to the roughing unit, that is to say, a roughing push bench in the known type of construction. Thus, a finishing push bench of very great length is obtained, and, since the roughing push bench in the known type of construction also effects at least 50 percent, preferably 65 to 80 percent, of the total reduction in cross section performed by the plant, the roughing push bench also has very large dimensions, so that, overall, there is a considerable spatial requirement, and the large and heavy parts of the plant involve high capital expenditure.

An object of the invention is to provide a plant by which particularly long tubular blooms in excess of 20 meters can be manufactured, but which involves lower capital expenditure and shorter overall lengths.

In accordance with the invention, in a plant for the manufacture of seamless tubes, having a finishing push bench upstream of which is disposed at least one roughing unit such as a skew rolling mill or a roughing push bench for stretching and reducing an ingot or pierced blank to form a roughed bloom, in addition to the known one or two smoothing sizing passes, the finishing push bench is only equipped with a number of drawing passes which can be used simultaneously on a tubular bloom without risk.

This means that, in addition to the one or two smoothing sizing passes which operate without any appreciable reduction in cross section, six or seven drawing passes at the most are used in the finishing push bench and, together, effect a maximum reduction in cross section of 70 to 80 percent. Thus, in accordance with the invention, the only sizing passes to be used in the finishing push bench are those which, in a known push bench, are simultaneously in operation at the end of the elongation operation. In the finishing push bench in accordance with the invention, all the other drawing passes are to be omitted.

Thus, in the first instance, there is a considerable reduction in the length of the finishing push bench. This is due, on the one hand, to the fact that all the front sizing passes otherwise provided are absent. Moreover, the existing drawing passes, for example, six drawing passes, and the following smoothing sizing pass or the two following smoothing sizing passes can follow one another at minimum distances apart, since all these sizing passes may act upon the tubular bloom simultaneously and, consequently, there is no need to prevent this by disposing them at greater distances apart. Consequently, the distance between the sizing passes need only depend upon the structural necessities, that is to say, the thickness of the roller stands and the spacing necessary for maintainance and assembly. A distance of, for example, 0.6 meter between sizing passes is a liberal dimension, and a maximum length of the set of sizing passes of the stand bed of 5 meters ensues in the case of six to seven drawing passes and one to two smoothing sizing passes. Compared with this, the set of sizing passes of the finishing push bench of the known plant has a length of 22 meters. The length of the finished bloom of, for example, 22 meters, does not affect the length of the set of sizing passes of the finishing push bench in accordance with the invention. As hitherto, the stroke of the finishing push bench results from the total of the length of the rough bloom, the length of the roller bed, and the length of the finished bloom. In the plant in accordance with the invention, this results in a stroke of approximately 33 meters, again with a finished bloom having a length of, for example, 22 meters. In comparison with this, the known plant would have a substantially greater stroke of 50 meters for the same length of a finished bloom. This considerable reduction in the length of the stand bed and the stroke in the finishing push bench in accordance with the invention leads to a substantially shorter and lighter plant. The considerably shorter length of the stand bed and the considerably shorter stroke result in a shorter cycle time and thus enable an increased throughput.

However, the considerable reduction in the length of the stand bed and thus in the length of the entire finishing push bench and its stroke are not the only causes of considerable savings in the plant in accordance with the invention, since the maximum first pass entry cross-sectional area in the finishing push bench in the system in accordance with the invention is smaller than that in the known type of construction, since, in the latter, a smaller amount of elongation is effected in the roughing unit. It will be appreciated that, in the plant in accordance with the invention, the elongation in the roughing unit must be greater than that in the known type of construction when considerations are based on the same total elongation in the plant between the ingot or pierced blank on the one hand and the finished bloom on the other hand. The larger amount of cogging in the plant in accordance with the invention necessitates a smaller maximum first pass entry cross-sectional area in the finishing push bench, so that, with the same specific bearing load, the diameter of the rolls can be reduced. Smaller roll diameters reduce the risk of compression during the elongation of small wall thicknesses. Furthermore, the pushing force is reduced owing to the reduced rod friction. Thus, overall, a substantially lighter and thus less expensive finishing push bench is also provided for the last-mentioned reasons.

Thus, the plant in accordance with the invention performs a substantially larger portion of the total elongation required in the region of the roughing unit than that performed by the known plant.

This results particularly in a greater length of the roughed bloom and, when the roughing unit is a roughing push bench, it also has a stand bed of greater length and longer stroke than that in the known plant. However, it was found, unexpectedly, that the advantages achieved by the finishing push bench in accordance with the invention are in no way nullified by transferring a larger proportion of the total elongation to the roughing unit, but that, overall, a plant is provided which is considerably shorter, lighter and thus more economical than the known plant.

In order to demonstrate this in detail, the length of the roughed bloom will be considered in the first instance. In the plant in accordance with the invention, as is also the case in the known tube push benches, the total reduction in cross section performed by all sizing passes which are simultaneously in operation towards the end of the elongation operation can amount to 70 to 77 percent before the above-mentioned undesirable phenomena occur. In the plant in accordance with the invention, this reduction in cross section would, at the same time, also be the total reduction in cross section performed by the finishing push bench, corresponding to a 3.3-fold to 4.3-fold elongation. The length of the roughed bloom is from 5.1 to 6.6 meters if a length of 22 meters is again taken as a basis for the finished bloom. This length of the roughed bloom is only slightly larger than that in the case of the known tube push bench described in German patent specification (Offenlegungsschrift) No. 28 12 778 and requires only slight additional expenditure, as will be set forth hereinafter.

Since the length of the roughed bloom affects the length of the set of roughing passes in the roughing push bench, and the plant in accordance with the invention is intended to produce longer roughed blooms, the stand bed of the roughing push bench also becomes longer. However, this lengthening of the stand bed of the roughing push bench is kept within close limits in the plant in accordance with the invention in which the elongation in the finishing push bench is substantially the same for all wall thicknesses of the blooms, since it corresponds to the above-mentioned limiting values of approximately 3.3 to 4.3. Since the total elongation from the pierced blank to the finished bloom becomes smaller as the wall thickness of the blooms increases, the elongation in the roughing push bench is also smaller in the case of a finished bloom having a thicker wall. If the same great length of the finished bloom is required, although a greater wall thickness of the finished bloom is required, it follows that a larger quantity of material has to be used, that is to say, the pierced blank must have a greater weight. Since, for reasons of economy, it is always desirable to proceed from starting material of the same cross section, and it is also desired, as far as possible, not to change the tools of the piercing press, the greater weight of the pierced blank is not achieved by virtue of its cross-sectional dimensions, and a pierced blank of a greater length is used when the finished bloom is to have a larger wall thickness. Consequently, the maximum elongation in the roughing push bench occurs with a pierced blank of the shortest length, while a far smaller amount of elongation is required in the case of a pierced blank of maximum length. This results in advantageous utilization of the stand bed, since, in the case of a large amount of elongation, which is tantamount to a larger number of sizing passes, the sizing passes can be placed at shorter distances apart owing to the shorter length of the pierced blank. By way of example, if a finished bloom of 22 meters in length is produced with a maximum 4.3-fold degree of elongation in the finishing push bench and with a maximum 48-fold total degree of elongation, a length of the set of roughing passes of approximately 11 meters is required in the roughing push bench. A length of the set of roughing passes of 8.8 meters is still also required in the roughing push bench in the known plant in which the reduction in cross section in the roughing push bench is, for example, 72 percent, the same maximum total degree of elongation and the same pushing force in the roughing push bench having been taken as a basis. This results in an increase of only 2.2 meters in the length of the set of roughing passes in the plant in accordance with the invention, this being far smaller than the considerable reduction in the length of the finishing pushing bench mentioned above. Thus, the total length of the two push benches becomes significantly smaller and thus the prime costs are also reduced.

The stroke in the roughing push bench results from the sum of the length of the pierced blank, the length of the stand bed and the length of the roughed bloom. In the chosen example, a stroke of 19 meters results in the plant in accordance with the invention, whereas the stroke would be 15 meters in the known plant. Thus, here also, there is only a slight increase in the stroke in the region of the roughing push bench in the plant in accordance with the invention, although, as set forth above, there is a substantially greater shortening of the stroke in the region of the finishing bench.

It will be clearly seen from the numerical examples given that the additional expenditure in the region of the roughing push bench is relatively small in the plant in accordance with the invention, although in return for this, substantially greater savings are achieved in the region of the finishing push bench. Difficulties also do not arise in connection with the pushing speeds. If operation in the known plant is effected at, for example, a pushing speed of 3 meters per second in the roughing push bench, which corresponds to a normal value, the same station time can be achieved with the plant in accordance with the invention at a pushing speed of 4 meters per second. This pushing speed is not particularly high and is even capable of being increased, since pushing speeds of up to 6 meters per second are achieved nowadays.

In order to obtain a short dwell time of the mandrel rod in the roughed bloom, it is desirable to operate with the mandrel rod fixed in the roughing push bench. The same mandrel rod is then used repeatedly in successive pushing operations and, during the return motion of the roughing push bench, is withdrawn from the roughed bloom which for this purpose is held by a stripper. Even this does not cause any appreciable difficulties, since it is known from the operation of earlier push bench plant that mandrel rods can be readily withdrawn from tubes up to 8 meters in length without the use of a releasing mill. In addition to this, the task is facilitated by virtue of the fact that the period of contact between the mandrel rod and the roughed bloom is shorter in the plant in accordance with the invention than in conventional finishing push benches, since the stroke of the roughing push bench in accordance with the invention is always relatively small. Since the roughing push bench does not produce finished blooms, the mandrel rod of the roughing push bench can also be of slightly conical configuration, and sizing passes of relatively highly oval configuration can be used. Both these measures are suitable for releasing the roughed bloom from the mandrel rod and thus facilitating the stripping of the roughed bloom from the mandrel rod.

Thoroughly comparable advantages are obtained if, in accordance with another embodiment of the invention, a skew rolling mill is used instead of a roughing push bench as the roughing unit, since, as in the aforementioned embodiment of the invention, the finishing push bench is also very short. Alternatively, the relatively elongated roughed blooms can be produced directly from circular ingots in a skew rolling mill of known construction. It is thereby readily possible to increase the weight of the material to be worked. Of course, when using a skew rolling mill as a roughing unit, a load-bearing base or an inwardly directed rim has to be formed at the end of the roughed bloom after the rolling operation in order to enable the pushing operation in the finishing push bench. However, it has to be borne in mind that the stress on the base is only slight owing to the relatively small pushing force in the finishing push bench and owing to the high transmission of frictional force between the surface of the mandrel rod and the finished bloom in the finishing push bench. Furthermore, it has to be borne in mind that the wall thickness of the roughed blooms is far less than that in conventional push bench methods in which a skew rolling mill is disposed in advance, and that the roughed blooms can therefore be more readily deformed.

In a further development of the invention, it is advisable to dispose in advance of the finishing push bench, a device for inserting mandrel rods into the roughed blooms. In this manner, it is possible to obtain a further substantial shortening of the stroke in the finishing push bench. With the greater length of the roughed blooms, it is advantageous to provide an additional device of this kind, since a considerable proportion of the stroke of the finishing push bench would otherwise have to be used for inserting the mandrel rod into the roughed blooms. This insertion requires far smaller forces than those required for the actual elongation operation. Nevertheless the powerful drive and the large masses of the finishing push bench have to be moved for the purpose of inserting the mandrel rod, and this can be effected more economically by a special device. In general, the economy is not yet realized in the case of the roughing push bench, since the length of the pierced blanks in the roughing push bench is too short. The considerably greater length of the roughed blooms renders such a device more economical and, moreover, the stroke in the finishing push bench is additionally shortened from 33 meters to 27 meters in the example generally used above, thus leading to smaller plant. Furthermore, the cycle time is rendered still shorter and the throughput is further increased.

The invention will be further described, by way of example, with reference to the accompanying drawings in which.

Figure 1:
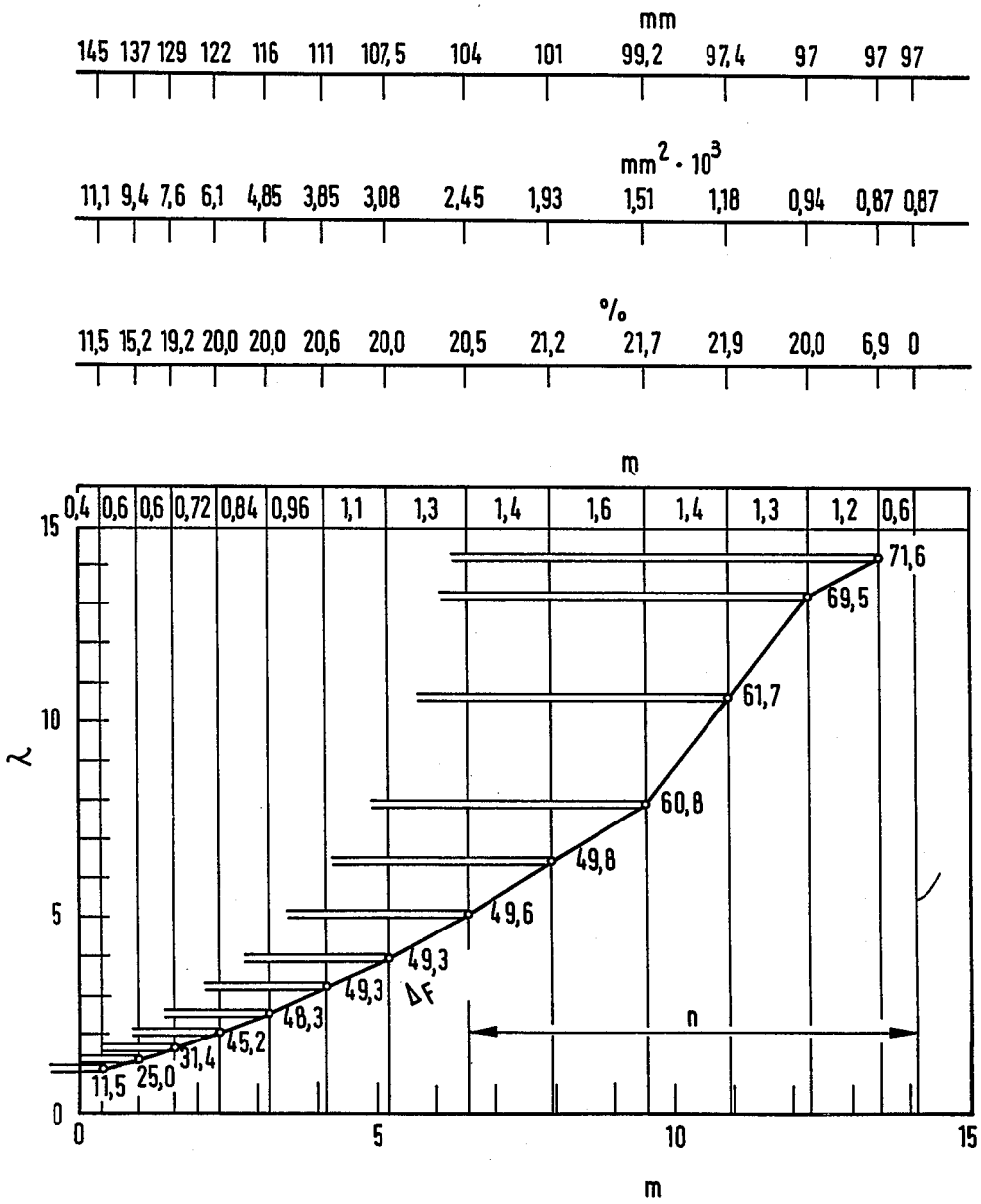
FIG. 1 is a graph showing the most important data of a known tube push bench.

Referring to FIG. 1, the required length of the stand bed is plotted along the abscissa in meters for a tube push bench in which the diameter of the mandrel rod is 90 millimeters and the finished bloom obtained has an external diameter of 96 millimeters in the case of a tubular bloom having a length of 12 meters. Thus, the tube push bench is a conventional tube push bench, and it will be seen at the top edge of the graph that the distance between the stands increases towards the delivery end. In this example, the pierced blank is elongated in a total of 13 sizing passes and a 14 sizing pass serves as a smoothing sizing pass in which the reduction in diameter is substantially zero. The ordinate shows that the total degree of elongation is approximately 14-fold, corresponding to a total reduction in cross section of approximately 93 percent. The reduction in cross section in the individual sizing passes is plotted in detail above the actual graph. The illustration of the lengths of the tubular blooms whenever the base of a tubular bloom has reached a further sizing pass clearly shows that only a limited number of sizing passes participates simultaneously in the elongation operation. The maximum number of sizing passes operating simultaneously is six, that is, when the base of the tubular bloom enters the last drawing pass. The tubular bloom then has a length of approximately 7 meters before it has passed through the last drawing pass. The length of the finished bloom is then 12 meters. It is also clearly shown how the number of simultaneously operating sizing passes increases during the course of the elongation operation.

In the plant in accordance with the invention, the finishing push bench only has those sizing passes which are indicated by the arrow "n" in FIG. 1. In the plant in accordance with the invention, the functions of the sizing passes located in advance of the aforesaid sizing passes are undertaken by the roughing push bench. It is to be pointed out that the distances between the stands in the region of the sizing passes "n", which can be read from the graph, do not apply to the plant in accordance with the invention but are uniformly approximately 0.6 meters and substantially shorter than in the graph, shown in FIG. 1 of a known tube push bench.

Figure 2:
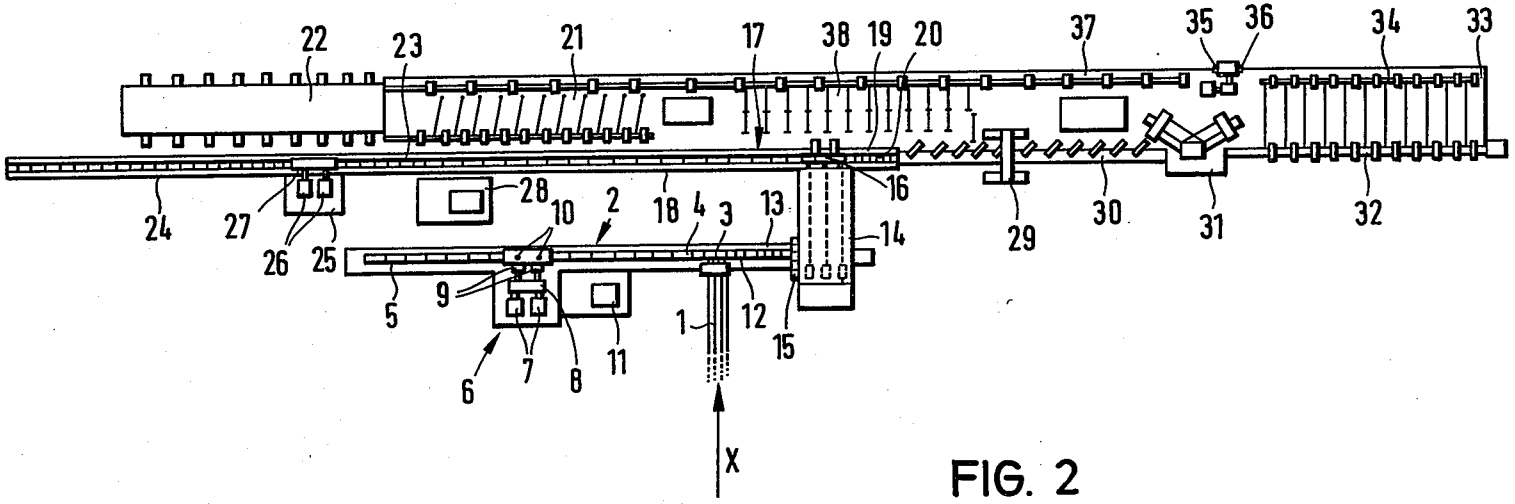
FIG. 2 is a plan view of a plant having a roughing push bench and a finishing push bench in accordance with the invention.

Referring to FIG. 2, pierced blanks are fed to a roughing push bench 2 by a transverse conveyor 1. The pierced blanks come from a known piercing press (not illustrated) from the direction of the arrow x and have a sufficiently high temperature for hot working. The pierced blanks are in the form of a very thick-walled cylinder whose interior bore is closed at one end by a base. The pierced blanks are fed by way of the transverse conveyor 1 to a depositing table 3 of the roughing push bench 2 onto which they are individually deposited. A mandrel rod is axially displaceably mounted in a mandrel rod guide 4 and is driven by a toothed rack which is also axially displaceably guided in a toothed rack guide 5. The drive for the toothed rack is generally designated 6 and chiefly comprises two drive motors 7, a step-down transmission 8, two clutches 9 and two drive pinions 10 which mesh directly with the toothed rack. A pumping station 11 is provided for supplying lubricating oil and pressurized oil for certain working cylinders (not described).

When a pierced blank is located on the depositing table 3, the drive 6 moves the toothed rack to the right (as viewed in FIG. 2) in the toothed rack guide 5 and, together therewith, moves the mandrel rod along the mandrel rod guide 4, so that the leading end portion of the mandrel rod is first pushed into the bore in the pierced blank until it abuts against the base of the pierced blank. The mandrel rod then pushes the pierced blank through the sizing pass openings of roller stands 12 which are disposed in line one behind the other in a roller stand bed 13. The pierced blank is thereby worked to a roughed bloom which already has a substantially smaller wall thickness and greater length than the pierced blank. The roughed bloom thus formed passes onto a second transverse conveyor 14 after the mandrel rod has been withdrawn and the roughed bloom has been stripped therefrom. A stripper means 15 is disposed between the second transverse conveyor 14 and the roller stand bed 13 and holds back the roughed bloom on the second transverse conveyor 14 whilst the mandrel rod is being withdrawn by the drive 6 from the roughed bloom and the roller stands into the mandrel rod guide 4 where the mandrel rod remains ready for the next working stroke.

The roughed bloom produced in the roughing push bench 2 in this manner is fed by way of the second transverse conveyor 14 to the depositing table 16 of the finishing push bench generally designated 17. Like the roughing push bench 2, the finishing push bench 17 also has a mandrel rod guide 18 in advance of the depositing table 16 in the pushing direction, and a roller stand bed 19, provided with roller stands 20, beyond the depositing table 16. Since the deposited roughed bloom in the finishing push bench 17 is already substantially longer than the pierced blank in the roughing push bench 2, somewhat greater lengths result in all portions of the finishing push bench. Furthermore, contrary to the roughing push bench 2, the same mandrel rod cannot be used repeatedly in the finishing push bench 17, a separate mandrel rod being required for each tubular bloom. This mandrel rod is deposited in the region of the mandrel rod guide 18 from the side a short distance in advance of the depositing table 16. Depositing is effected from a supply bed 21 where the mandrel rods are kept in readiness. If it is necessary to pre-heat the mandrel rods, this is done in a mandrel rod furnace 22 from which the mandrel rods are transferred individually to the supply bed 21, although, this is done only shortly before depositing the mandrel rod in the mandrel rod guide 18.

The mandrel rod is driven in the mandrel rod guide 18 by a shaft rod which is axially slidingly guided in a shaft rod guide 23. The shaft rod is driven by a toothed rack located in a toothed rack guide 24. The drive for the finishing push bench 17 is designated 25 and comprises two drive motors 26 which act directly upon two drive pinions 27. The drive pinions 27 mesh directly with the toothed rack. The pumping station 28 supplies the individual guides, bearings and a few working cylinders with the required lubricating oil and pressurized oil. The crossing 29 enables the operator to cross the finishing push bench 17 in safety.

When the roughed bloom has been pushed through the sizing passes of the roller stands 20 and has been converted to the finished bloom, only the shaft rod in the finishing push bench 17 is withdrawn by means of the toothed rack and the drive 25, while the mandrel rod in the finished bloom is conveyed to a releasing mill 31 by way of a roller bed 30. The finished bloom is deformed in the releasing mill 31 only to the extent that it is no longer firmly seated on the mandrel rod and can be stripped therefrom. A further roller bed 32 beyond the releasing mill 31 receives the finished bloom after the releasing operation with the mandrel rod still located therein, and a further transverse conveyor 33 conveys the finished bloom, with the mandrel rod located therein, to a withdrawal roller bed 34 which extends parallel to the roller bed 32. A mandrel rod extractor 35 is located beyond the releasing mill 31, but in line with the withdrawal roller bed 34 and grips the trailing end of the mandrel rod not overlapped by the finished bloom and withdraws the mandrel rod from the finished bloom towards the left as viewed in FIG. 1. To ensure that the finished bloom remains on the withdrawal roller bed 34, the mandrel rod extractor 35 has a stripper means 36 against which the trailing end face of only the finished bloom abuts, whereas the mandrel rod is withdrawn by the mandrel rod extractor 35 from the finished bloom through the recess in the stripper means 36. The mandrel rod which is then free is subsequently transferred to a mandrel rod roller bed 37 from which the mandrel rod is fed to the mandrel rod furnace 22 or to the supply bed 21 or to the mandrel rod cooling bed 38.

I claim:

1. A plant for the manufacture of seamless tubes, having a single finishing push bench upstream of which is disposed at least one roughing unit, for stretching and reducing an ingot or pierced blank to form a roughed bloom, in which, in addition to the known one or two smoothing sizing passes, the number and arrangement of the drawing passes in said single finishing push bench is such that at one point in time they are all simultaneously engaged on a tubular bloom to be rolled.

2. A plant as claimed in claim 1, in which a device for inserting a mandrel rod into the roughed blooms is disposed upstream of the finishing push bench.

3. A plant as claimed in claim 1 wherein the finishing push bench is equipped with all sizing passes which are simultaneously in operation with the finishing passes on a tube at the end of the elongation operation.

4. A plant as claimed in claim 1 wherein the roughing unit is a roughing push bench having a pass line along side and generally parallel to the finishing push bench and means are provided for transferring a roughed billet from the roughing push bench to the finishing push bench.

* * * * *